US006518992B1

(12) United States Patent
Jimbo

(10) Patent No.: US 6,518,992 B1
(45) Date of Patent: Feb. 11, 2003

(54) THERMAL LINE PRINTER AND A METHOD OF DRIVING THE SAME

(75) Inventor: Seiichi Jimbo, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/638,260

(22) Filed: Aug. 11, 2000

(30) Foreign Application Priority Data

Aug. 26, 1999 (JP) ..... 11-239284

(51) Int. Cl.[7] ..... B41J 2/355
(52) U.S. Cl. ..... 347/180
(58) Field of Search ..... 347/180, 187, 347/211, 181–182, 175, 186, 172; 400/120.05, 120.03, 120.06, 120.07, 120.02; 358/433

(56) References Cited

U.S. PATENT DOCUMENTS 5,717,837 A * 2/1998 Asai et al. ..... 347/181

* cited by examiner

*Primary Examiner*—John Barlow
*Assistant Examiner*—K. Feggins
(74) *Attorney, Agent, or Firm*—Adams & Wilks

(57) ABSTRACT

To provide a thermal line printer and a method of driving the thermal line printer, which may suppress the degradation in printing quality such as non-uniformity in density caused by the sticking phenomenon. A method of driving a thermal line printer for performing thermal recording onto thermal paper to be fed by a drive of a stepping motor with a thermal line head where a plurality of heating resistors are arranged in a linear manner on a line perpendicular to a paper feeding direction, includes the following steps of: dividing the thermal resistors of the thermal line head into n blocks (where n is an integer not smaller than one), and further constituting m groups (where m is an integer not smaller than zero) by the n blocks; and driving each of the groups in order, and driving the stepping motor after each drive to thereby perform a paper feed less than one dot.

18 Claims, 10 Drawing Sheets

THERMAL LINE PRINTER AND A METHOD OF DRIVING THE SAME

BACKGROUND OF THE INVENTION

1. Field of the Invention

The present invention relates to a thermal line printer for performing thermal recording by a thermal line head and a method of driving the thermal line printer.

2. Description of the Related Art

A thermal line printer using a thermal line head where a plurality of heating resistors are arranged in a linear manner for thermally recording an image, a letter or the like onto thermal paper having a predetermined size is well known. In general, the thermal line head in such a type of a printer is divided into a plurality of blocks to be driven and controlled. The reason why the printer head is thus divided into a plurality of blocks and driven is because a very large amount of consumption power is needed when the electricity is applied to all the heating resistors to be simultaneously driven. This leads to an enlargement of a power source device, resulting in an increase in cost.

In such a printer, in the case where it is driven at a high printing rate (a rate of the heating resistors to be heated and driven and a rate of a so-called black printing), or in the case where it is driven under a low temperature circumstance, a so-called "sticking" phenomenon takes place.

The sticking phenomenon is a condition in which the thermal paper would stick to the thermal head due to a high printing rate, causing non-uniformity in feeding the thermal paper.

The cause for occurrence of the sticking phenomenon will now be described in brief with reference to FIGS. 8 to 10. FIG. 8 is a cross-sectional view showing a schematic structure of the thermal paper, FIG. 9 is an explanatory view schematically showing a condition where the sticking phenomenon takes place in the overcoat layer, and FIG. 10 is a time chart showing an example of a method of driving the conventional thermal line printer.

First of all, as shown in FIG. 8, it should be noted that the thermal paper K has a structure in which a base paper 101 is coated with a thermally sensitive layer 102 and an overcoat layer 103. Then, when a heating resistor 10 of a thermal line head H supplied with electricity in response to a print command, it is heated and the thermally sensitive layer 102 reacts to develop color. In this case, the overcoat layer 103 is molten and solidified after the elapse of a predetermined period of time (for example, one millisecond), so that the surface of the heating resistor 10 of the thermal line head H is stuck to the thermal paper K (see FIG. 9). For this reason, it is impossible to precisely feed the thermal paper K, leading to non-uniformity in pitch and resulting in defects such as degradation in printing quality. This is called sticking phenomenon.

A process of the occurrence of the sticking phenomenon in the conventional thermal line printer will now be briefly described with reference to the time chart shown in FIG. 10.

In this example, the thermal line head of the printer is divided into six blocks (Block 1 to Block 6). Then, printing is performed in order in a time division manner in all the blocks during a period Tc between one step drive and another step drive by a stepping motor. In this case, since it takes a relatively long period of time t1 from the completion of the printing by the head of Block 6 till the motor is step driven next, the overcoat layer 103 of the thermal printer K that has been once molten by heating of the head of Block 1 or the heads of Block 2 to Block 5 onward is cooled and solidified to cause the above-described sticking phenomenon, resulting in defects such as degradation in quality of printing.

Therefore, as shown in FIG. 11, there is an approach to apply a short pulse to every block again for the purpose of melting the overcoat layer after the completion of supply of electricity (Japanese Patent Application Laid-Open No. Hei 10-109435).

However, according to this method, since the pulse is applied in order to each block, a period of time t1' from the application of the pulse to the final block until the paper feed exceeds the solidification necessary time of one millisecond in the first block so that the overcoat layer is solidified to cause the sticking phenomenon, disadvantageously.

SUMMARY OF THE INVENTION

The present invention has been made to solve the above problems, and an object of the present invention is therefore to provide a thermal line printer and a method of driving the thermal line printer, which may suppress the degradation in printing quality such as non-uniformity in density caused by the sticking phenomenon.

In order to attain this and other objects, according to the present invention, there is provided a method of driving a thermal line printer for performing thermal recording onto thermal paper to be fed by a drive of a stepping motor with a thermal line head where a plurality of heating resistors are arranged in a linear manner on a line perpendicular to a paper feeding direction, the method comprising the steps of: dividing the thermal resistors of the thermal line head into n blocks (where n is an integer not smaller than one), and further constituting m groups (where m is an integer not smaller than zero) from the n blocks; and driving each of the groups in order, and driving the stepping motor after each drive to thereby perform paper feed by less than one dot.

According to this method, the paper feed is performed immediately after the drive of each group of the thermal line head to thereby make it possible to prevent the sticking phenomenon.

It is preferable to drive in a time division manner the heating resistors to be driven in each block of the groups in order with a predetermined number of divisions in the case where the size of data to be printed in each group of the thermal line head is equal to or larger than a predetermined value.

According to this method, the power to be consumed in driving the thermal line head can be kept from exceeding a fixed level.

It is preferable that the number of divisions of the time division driving is determined in accordance with a temperature of the thermal line head. With this method, it is possible to generate a suitable amount of heat from the thermal line head.

Also, it is preferable to simultaneously drive the heating resistors to be driven in each block of the groups continuously for a predetermined period of time in the case where the size of data to be printed in each group of the thermal line head is equal to or less than the predetermined value.

With this method, the n blocks forming the groups are simultaneously driven to thereby make it possible to enhance the processing speed while suppressing the consumption power down to a fixed level.

Also, according to the present invention, there is provided a thermal line printer provided with a paper feed means for transferring thermal paper by a drive of a stepping motor and a thermal line head where a plurality of heating resistors are arranged in a linear manner on a line perpendicular to a paper feed direction, comprising: a thermal line head dividing means for dividing the thermal resistors of the thermal line head into n blocks (where n is an integer not smaller than one), and further constituting m groups (where m is an integer not smaller than zero) from the n blocks; and a control means for driving each of the groups and driving the stepping motor after each drive, to thereby perform paper feed by less than one dot.

Also, it is preferable that the control means comprises: a judging means for judging whether the size of data to be printed in each group of the thermal line head is equal to or larger than a predetermined value; and time division driving means for driving in a time division manner the heating resistors to be driven in each block of the groups in order with a predetermined number of divisions in the case where the size of data to be printed in each group of the thermal line head is equal to or larger than a predetermined value.

Furthermore, it is preferable that the control means comprises a division number determining means for determining the number of divisions of the time division driving on the basis of a temperature of the thermal line head.

Also, it is preferable that the control means comprises: a judging means for judging whether the size of data to be printed in each group of the thermal line head is equal to or less than a predetermined level; and a simultaneous drive means for simultaneously driving the heating resistors to be driven in each block of the groups continuously for a predetermined period of time in the case where the size of data to be printed in each group of the thermal line head is equal to or less than the predetermined value.

DESCRIPTION OF THE PREFERRED EMBODIMENTS

A preferred embodiment of the present invention will now be described with reference to FIGS. 1 to 7.

Figure 1:
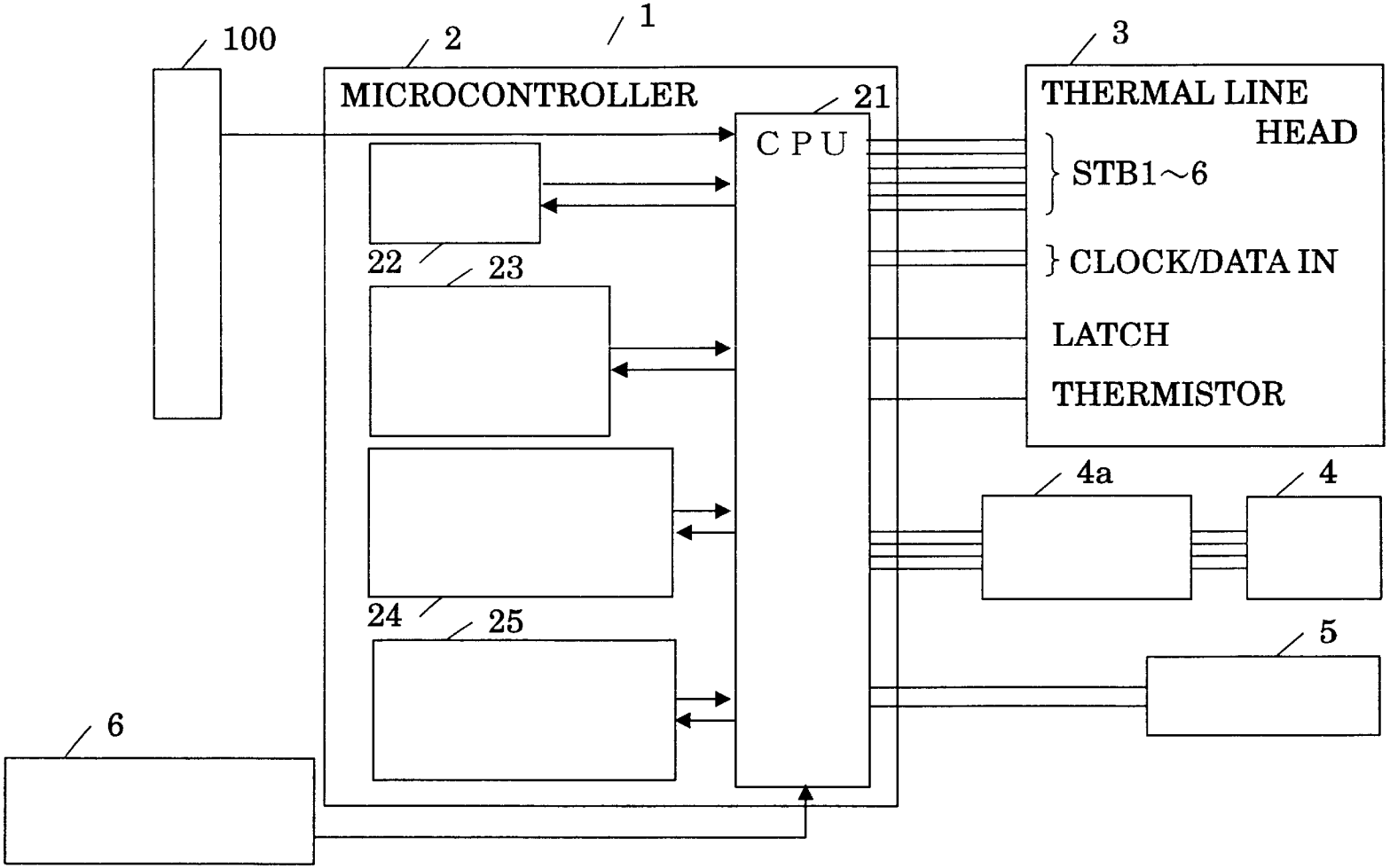
FIG. 1 is a block diagram showing an overall structure of a thermal line printer according to a preferred embodiment of the present invention.

FIG. 1 is a block diagram showing an overall arrangement of a thermal line printer 1 in accordance with the preferred embodiment of the present invention.

The thermal line printer 1 in accordance with this embodiment is a printer in which electricity is applied to heating resistors of a thermal line head 3 in response to printing data sent from, for example, an external host computer 100 while intermittently feeding a piece of thermal paper, thereby heating the thermal paper and making the thermal paper to react to the heat to perform the printing operation. This thermal line printer 1 is mainly composed of a micro-controller 2 for controlling the printer as a whole, the thermal line head 3 for making the thermal paper to react to heat in terms of dot unit, thereby performing a dot print, a stepping motor 4 for feeding the thermal paper in a longitudinal direction as a printing medium, a sensor 5 for detecting the presence/absence of the thermal paper, whether or not the thermal line head 3 is in operative position or the like, and a dip switch 6 for setting the maximum electrified dot number. Here, the maximum electrified dot number set in the above-described dip switch 6 means the maximum element number of the heating resistors to be simultaneously supplied with electricity for keeping the power consumption from exceeding a fixed level.

Provided in the above-described micro-controller 2 are a CPU (Central Processing Unit) 21 for performing a control process of the printer 1 or various calculation processes, a signal receiving buffer 22 for temporarily storing the print data sent from the host computer 100, a one-line print data buffer 23 for storing the print data for one line, a dot number buffer 24 for storing the dot number data representative of the dot number to be printed in each print block, and a sequencer (also referred to as PLC: Programmable Logic Controller) 25 as a thermal line head dividing means for performing the block dividing of thermal line head 3 corresponding to the maximum electrified dot number on the basis of the setout of the above-described dip switch 6 and assigning each print block and a strobe signal with each other by a hardware such as a relay circuit.

Here, the above-described CPU 21 constitutes a control means for controlling power supply to the heating resistors of the thermal line head 3 and for controlling a drive amount of the stepping motor 4,for paper feeding. In addition, this CPU 21 constitutes a judging means for making a judgment in relation with the power supply number of the heating resistors in the same set of the printing blocks, a time division drive means for dividing and driving the same set of the printing blocks, a division number determining means for determining the number of division and drives upon the time division drive, and a simultaneous drive means for simultaneously driving the same set of the printing blocks. Details of the time division drive, the simultaneous drive or the like will be described later.

Figure 2:
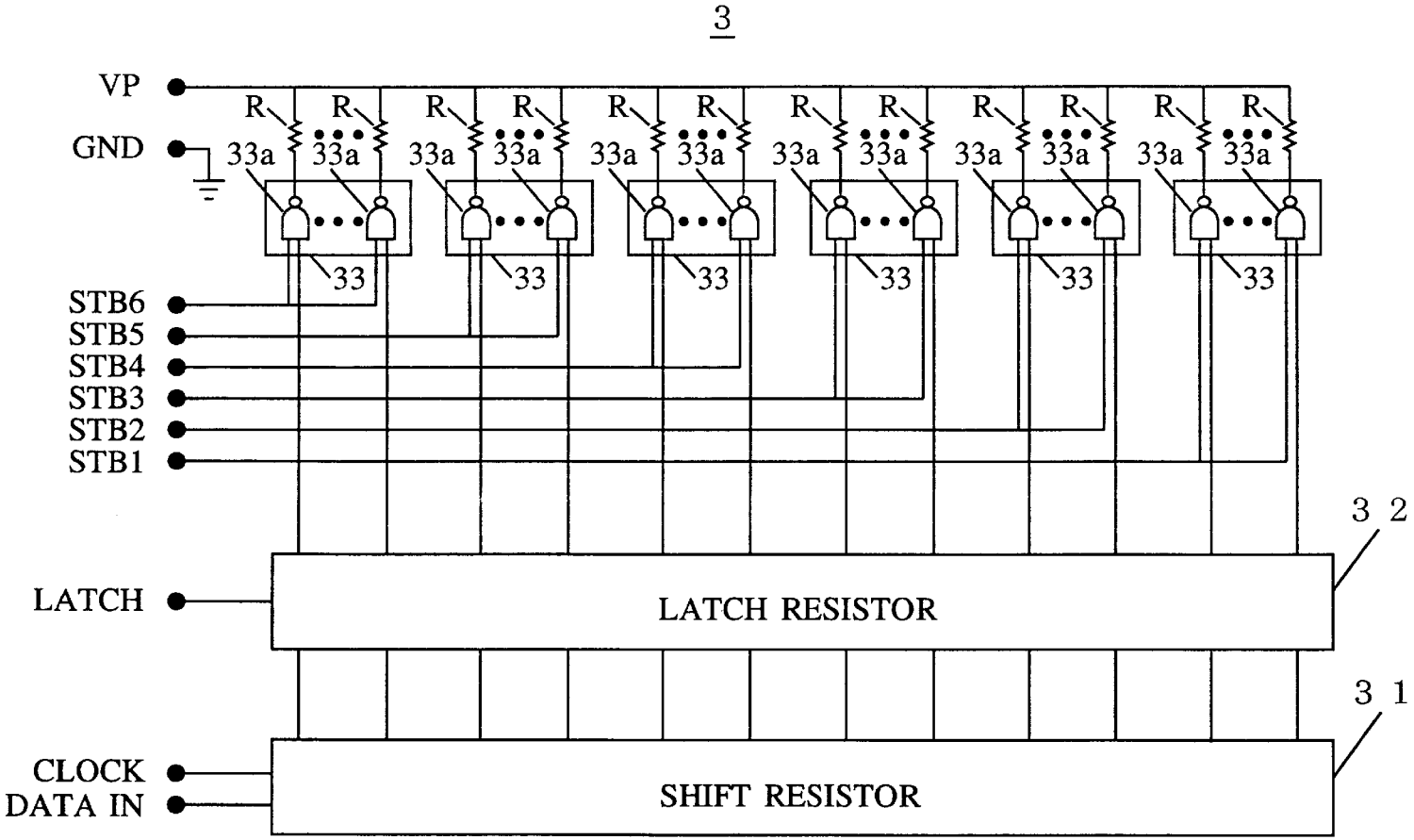
FIG. 2 is a structural view showing in detail a thermal line head of the thermal line printer according to the embodiment.

FIG. 2 is a view showing a detailed structure of the thermal line head 3.

The thermal line head 3 according to this embodiment includes, for example, 384 (64 dots×6 blocks) heating resistors R, . . . arranged laterally in one line, a shift register 31 into which the printing dot data for one line are serially inputted and held, a latch 32 for storing and holding the print dot data in parallel for one line from the shift register 31, selection circuits 33 each composed of a NAND circuit for selectively driving the heat resistor R . . . of each printing block in response to the print dot data of the latch 32 and strobe signals STB1 to STB6 from the CPU 21, and a thermistor (see FIG. 1) for detecting the temperature of the head portion. Out of the above-described 384 heating resistors R . . . , the heating resistors R . . . corresponding to the print data are supplied with the current flow, to thereby perform a desired pattern print for one line on the thermal paper.

The electric supply of the heating resistors R . . . is not performed all at once for one line due to the necessity to keep the power consumption of the printer from exceeding a fixed value but is performed for every printing block divided into a plural number (for example, six) of heating resistors R for one line. Then, the printing for one line is repeatedly performed while the thermal paper is intermittently fed, thereby performing the printing onto the entire surface of the thermal paper.

Note that the number of the above-described printing blocks is set to be changeable in accordance with the process of the sequencer 25, the setup of the above-described dip switch 6, etc., upon, for example, the initial setup of the thermal line printer 1. That is, when the condition of the dip switch 6 is set as desired to thereby perform the initial setup of the thermal line printer 1, the heating resistors R . . . are divided into a predetermined number (for example, 4 to 8) so as not to exceed the maximum electrified dot number indicated by the dip switch 6, and the respective numbers are set as the printing blocks. Furthermore, the above-described respective printing blocks (Block 1, Block 2, . . . ) and the strobe signals (STB1, STB2, . . . ) are caused to correspond to each other by the sequencer 25, thereby completing the setup change. Generally speaking, when the specification of the normal system is determined, the division number is also determined. Accordingly, during the use, the dip switch 6 is no longer changed. Hereinafter, the explanation will be made assuming that the heating resistors R . . . are divided into six so as to form one printing block with 64 dots.

In correspondence with the above-described setup, the selection circuits 33 are also divided into six blocks that is the same number as the printing blocks. The four NAND circuits 33*a* having the same number as the dot number at which the printing is possible in one printing block are provided in each block. The strobe signal STB1 (to STB6) set to be sent from the CPU corresponding to each block and the signal of the corresponding printing dot data from the latch 32 are inputted into the input terminal of each NAND circuit 33*a*. On the other hand, each of the above-described heating resistors R is connected to the output terminal side. Then in the case where both of the strobe signal STB1 (STB6) and the printing dot data are high, a voltage of low level is outputted on the output side so that the associated heating resistors R . . . are supplied with the electric power to be heated. That is, the printing dot data for one line are inputted into the latch 32 and any desired strobe signal is sent so that the dot printing is performed for the printing block corresponding to the strobe signal.

A preferred drive method in accordance with this embodiment with the thus constructed thermal line printer will now be described.

Figure 3:
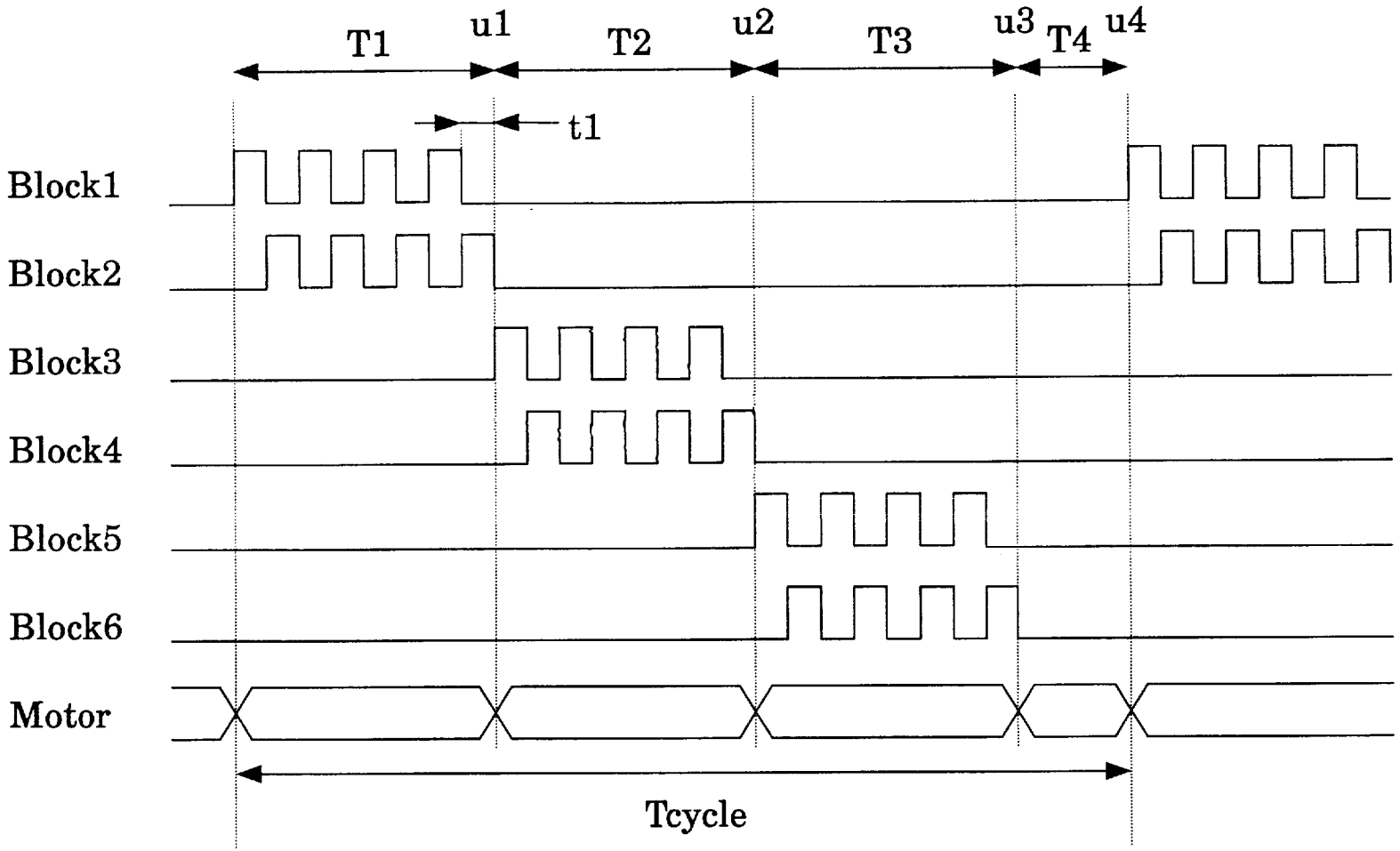
FIG. 3 is a time chart illustrating an example of a method of driving the preferred thermal line printer in accordance with the embodiment of the present invention.

FIG. 3 is a time chart for illustrating an embodiment of the drive method for the preferred thermal line printer to which the present invention is applied. In FIG. 3, waveforms denoted by reference symbols Block1 to Block 6 represent strobe signals STB1 to STB6 corresponding to each printing block, and waveforms denoted by reference symbol MOTOR represent changes of pulse signals inputted into the stepping motor 4.

The drive method of the thermal line printer in accordance with this embodiment is characterized by the following three features: the time division alternate drive for alternately driving the two printing blocks for a relatively short period of time, the two block parallel drive for driving simultaneously the continuous waveform in two blocks in the case where the electrified dot number in the two printing blocks is small, and the real time fine paper feed for feeding the thermal paper in terms of a smaller unit than one dot before the contact portion between the thermal line head 3 and the thermal paper is cooled by driving little by little the motor 4 for feeding the thermal paper before the printing for one line has-been completed.

Also as described above, in the case where the dot printing for one line is performed in the thermal line printer 1, it is preferable that all the printing for one line not be performed at once due to the necessity of keeping the power consumption from exceeding the fixed level, but that the printing be performed for every block by dividing the dot printing into a plurality (for example, six) of printing blocks. Also, in order to perform the desired dot printing onto the thermal paper, the electric supply has to be effected to the heating resistors for a predetermined period of time or more to give a predetermined heat quantity to the thermal paper. Incidentally, the electric supply period depends upon the heating temperature of the thermal line head that is to be used or the type of the thermal paper.

In order to meet these conditions, in this embodiment, first of all, the respective printing blocks are combined so as to form a plurality (for example, two) of groups, for example, combining Block1 and Block2 to form a group, Block3 and Block4 for another one, and Block5 and Block 6 for yet another one.

Then, when the printing process is started for one line, as shown in FIG. 3, in a period T1, a short pulse (for example, 0.5 milliseconds) is applied alternately to the heating resistors of the two printing blocks (Block1 and Block2) in the first set. Then, the application of the short pulse is performed a predetermined number of times (for example, four times) within the period T1, thereby obtaining the electric supply period needed for the heating resistors to perform the dot printing on the thermal paper. Incidentally, the number of the applications of the above-described short pulse depends upon the temperature of the thermal line head 3 or the type of the thermal paper used, and therefore the number of application of the short pulses is, in some cases, three or two. The electric supply period within one cycle for each block is somewhat longer than that of the conventional system for continuously supplying the electricity because the heat generation and cooling are repeated.

Also, in the period T1 when the above-described first set of blocks are driven, the motor 4 is not driven and the thermal paper is kept under the condition that it is at a standstill. Then, at a timing u1 when the drive of the first set of printing blocks (Block1 and Block2) has been completed, one pulse is outputted to the stepping motor 4 so that the thermal paper is fed by one fourth of one dot. This fine feed is realized by setting the gear ratio of the gear transmission mechanism provided between the motor and the paper feed roller to be four times larger than the case of one dot. The thermal paper is thus fed little by little for every block, so that the thermal paper that is molten at the contact portion with the thermal line head is caused to pass before it is cooled and solidified, thereby avoiding the sticking phenomenon.

That is, in this embodiment, since the thermal paper is fed after the final electric supply for the second printing block (Block2) is completed, the second block has no cooling period. The period t1 from the completion of the final electric supply for the first printing block (Block 1) until the final electric supply for the second block (Block2) is the cooling period, which is relatively short (about 0.5 milliseconds). Therefore, the sticking phenomenon does not take place.

Subsequently, similar process is effected also in the periods T2 and T3 for the second set of printing blocks (Block3 and Block4) and the third set of printing blocks (Block5 and Block6).

In this embodiment, since the printing blocks are divided into six blocks, the printing is completed by the drive of all three sets of blocks. Then, a pulse is outputted to the paper feed motor 4 at the timing u4 immediately before the printing process for the next line is started, and the thermal paper is fed in an idle manner by one fourth of the dot. Incidentally, it is possible to set the period T4 from the completion of the printing process for the third set until the timing u4 for the final feed to be shorter as desired. When the final idle feed is effected, the thermal paper is forwarded by one dot in total from the start of the three times of feeding by one fourth dots immediately after the printing block drive of the respective sets.

Then, the printing process for one line described above is repeatedly performed to finish the printing process for the overall thermal paper.

Figure 4:
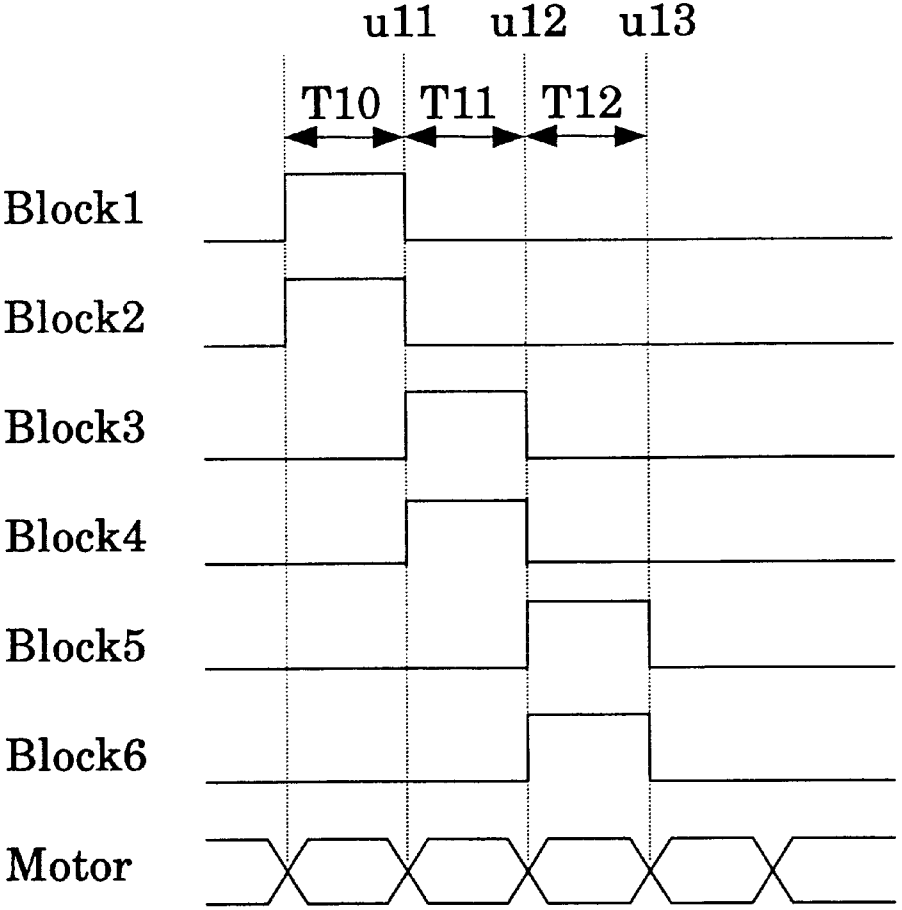
FIG. 4 is a time chart illustrating another example of the method of driving the thermal line printer in accordance with the embodiment of the present invention.
Figure 5:
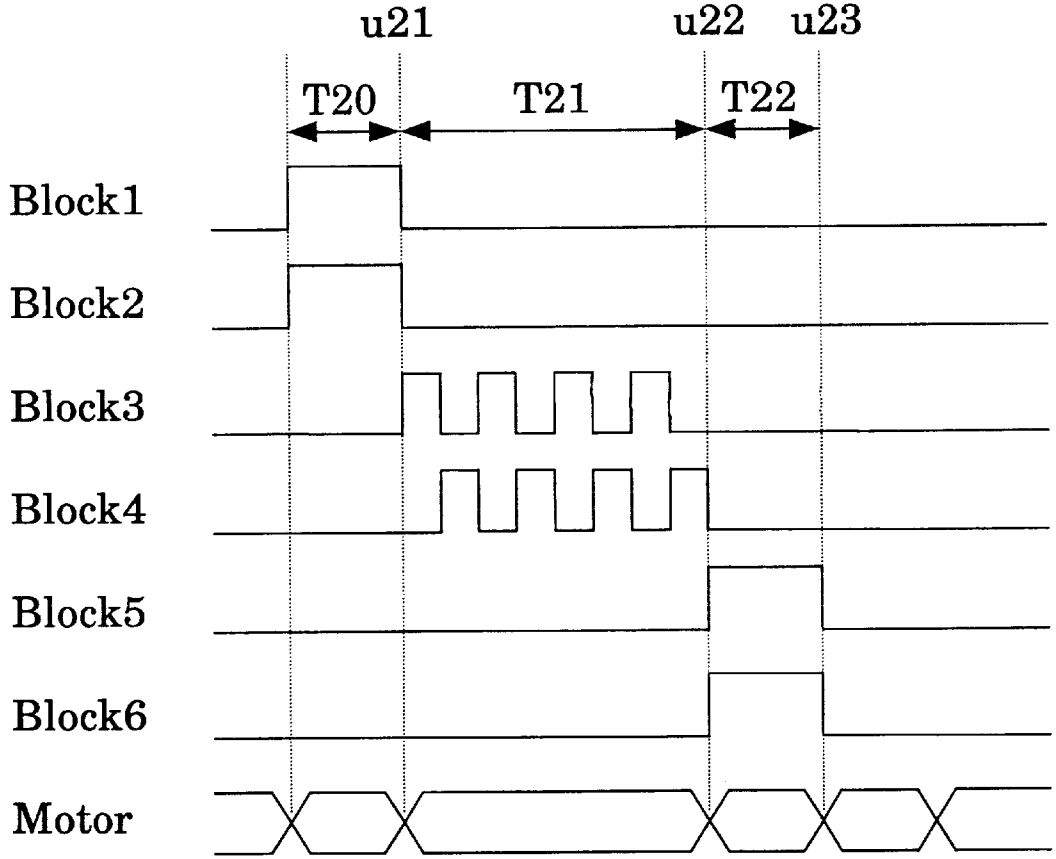
FIG. 5 is a time chart illustrating still another example of the method of driving the thermal line printer in accordance with the embodiment of the present invention.

FIGS. 4 and 5 are time charts showing other examples of the method of driving the thermal line printer in accordance with the embodiment.

Although the explanation has been omitted hereinbefore, the above-described alternate drive of the thermal line head 3 is performed in the case where the electrified dot number of each printing block exceeds a certain number (for example, half the number of the heating resistors R, . . . ). Another drive waveform is applied to the heating resistors R, . . . in the case where the electrified dot number is smaller than that value.

More specifically, when the printing process for one line is started, first of all, the electrified dot number in each printing block is counted on the basis of the printing dot data, and the counted value is stored in the dot number buffer 24. Subsequently, the sum of the electrified dot number of one set of the printing blocks for the printing process is calculated on the basis of the dot number data of the dot number buffer. If this sum exceeds the maximum electrified dot number, the process shown in FIG. 3 in which the pulse is alternately applied to one set of printing blocks is executed, whereas if this sum is less than the maximum electrified dot number, the process shown in FIG. 4 in which the pulse is simultaneously applied to one set of printing blocks, i.e., two blocks is executed.

FIG. 4 shows the drive waveform in the case where the respective dot numbers in the three sets of printing blocks are less than the maximum electrified dot number. In this case, in the period T10, the first set of printing blocks (Block1, Block2) are simultaneously driven, and subsequently, the second set of printing blocks (Block3, Block4) are simultaneously driven in the period T11 and the third set of printing blocks (Block5, Block6) are simultaneously driven in the period T12 in order. It should be noted here that since a continuous long pulse is applied to the heating resistors R, . . . to be supplied with electricity during the above-described periods T10 to T12, the length of these periods T10 to T12 are almost half the periods T1 to T3 in the case of the alternate drive shown in FIG. 3, and the cycle time of the printing process for one line is also half. Thus, even if the simultaneous drive with the continuous waveform is executed in the case of a small number of the electrified dots, since the electric supply amount for each block is inherently small, there is no fear that Age the consumption current would exceeds an allowable amount.

Also, FIG. 5 shows a drive waveform in the case where the sum of the electrified dot number of the first and third sets of printing blocks is not greater than the maximum electrified dot number, and the sum of the electrified dot number of the second set of the printing blocks is greater than the maximum electrified dot number. In this case, in the periods T20 and T22, two printing blocks (Block1 and Block2 or Block5 and Block 6) are driven simultaneously and continuously. In the period T21, the two printing blocks (Block3 and Block4) are alternately driven in the time division manner. The period T21 when two printing blocks are alternately driven is twice longer than the periods T20 and T22. However, due to the presence of the simultaneous drive periods T20 and T22, the cycle tyme of the printing process for one line is shorter than that of the conventional case.

The feed of the thermal paper in the case where one set of printing blocks is simultaneously driven is the same as the case shown in FIG. 3 in which the blocks are driven alternately. That is, at the timings u11 to u13 in FIG. 4 and at the respective timings 6 u21 to u23 in FIG. 5 where the printing process by each set of printing blocks has been completed, the thermal paper is fed by one fourth, respectively, and the sticking phenomenon is avoided because the paper feed is executed before the molten thermal medium is solidified. Then, the thermal paper is fed by one fourth dot in an idle manner also in a rest period after the printing process for all the sets of printing blocks has been finished, thereby completing the printing process for one line.

The procedure of the above-described printing process will now be described in more detail with reference to the flowcharts shown in FIGS. 6 and 7.

Figure 6:
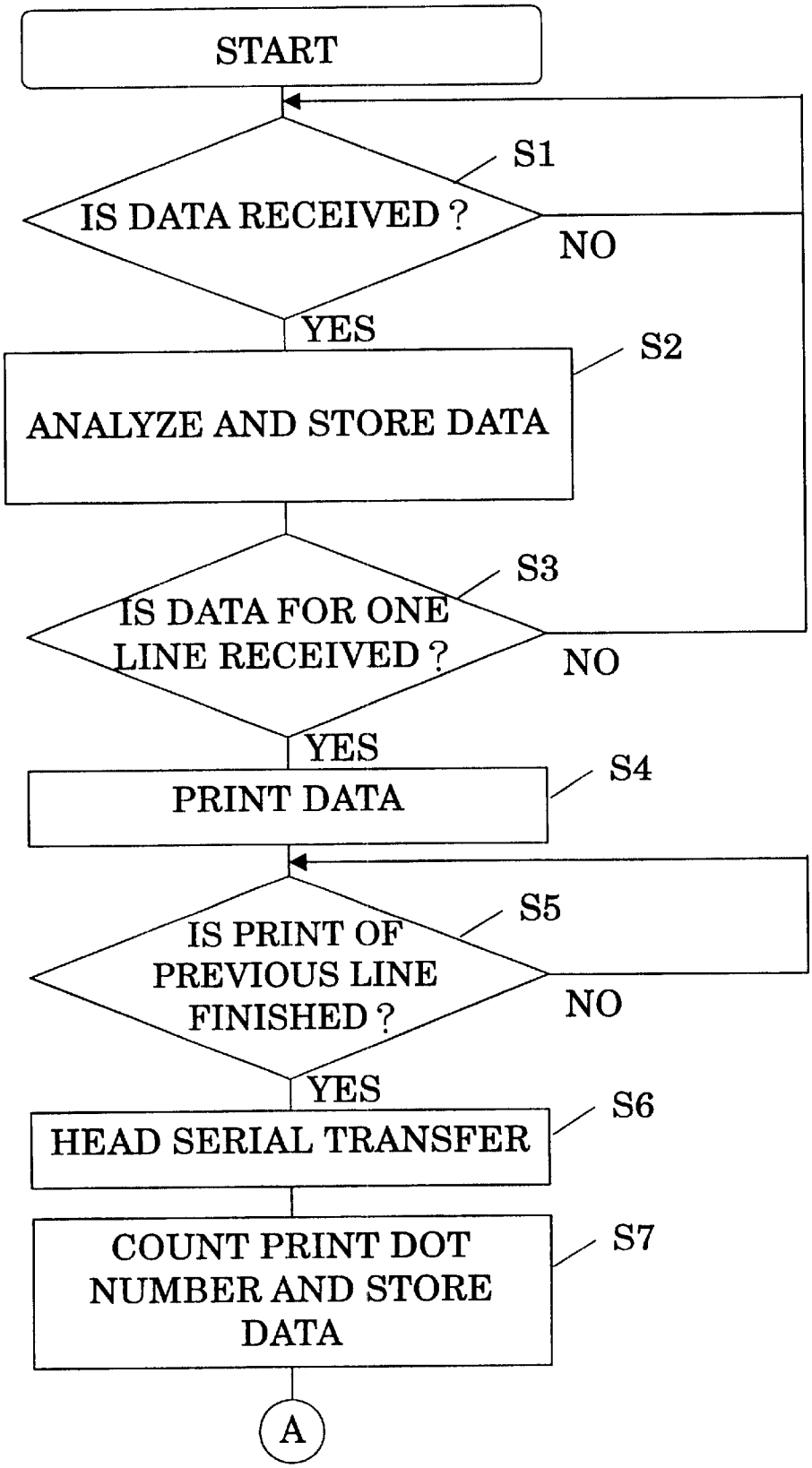
FIG. 6 is a flowchart (former half) showing an example of the procedure of a printing process that is executed by a CPU shown in FIG. 1.
Figure 7:
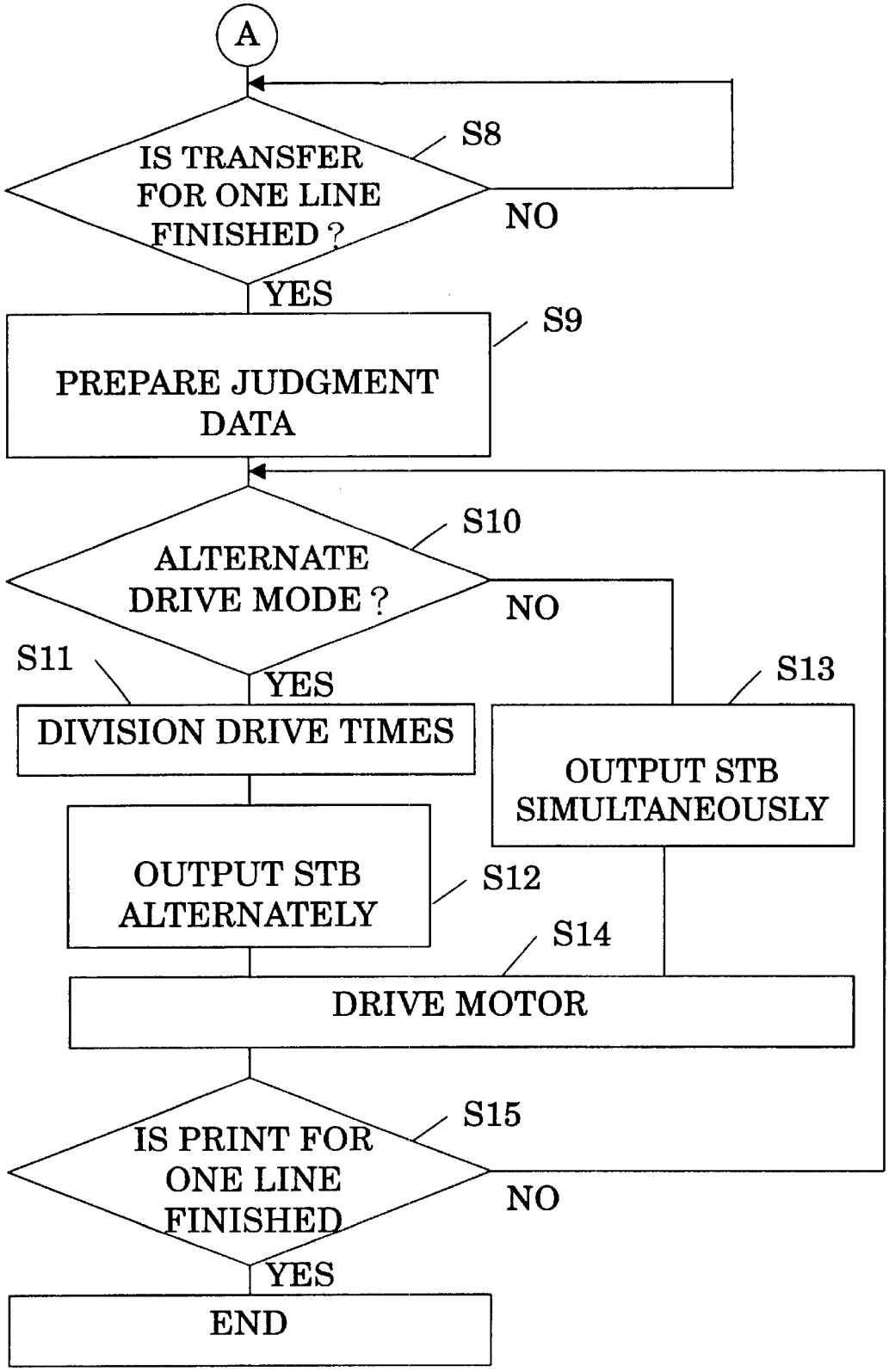
FIG. 7 is a flowchart (latter half) showing an example of the procedure of the printing process that is executed by the CPU shown in FIG. 1.
Figure 8:
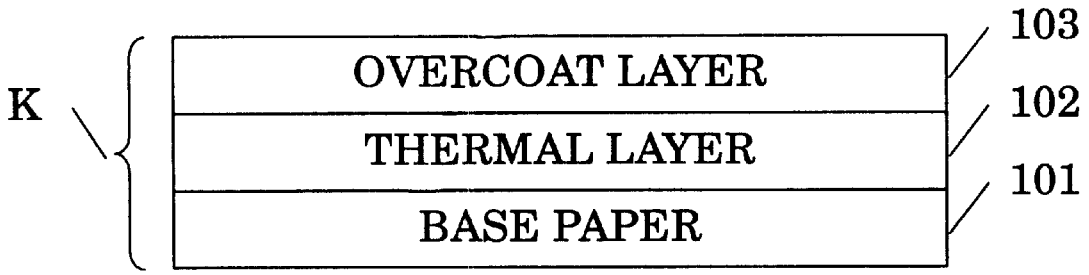
FIG. 8 is a schematic view showing the structure in cross-section of a sheet of thermal paper.
Figure 9:
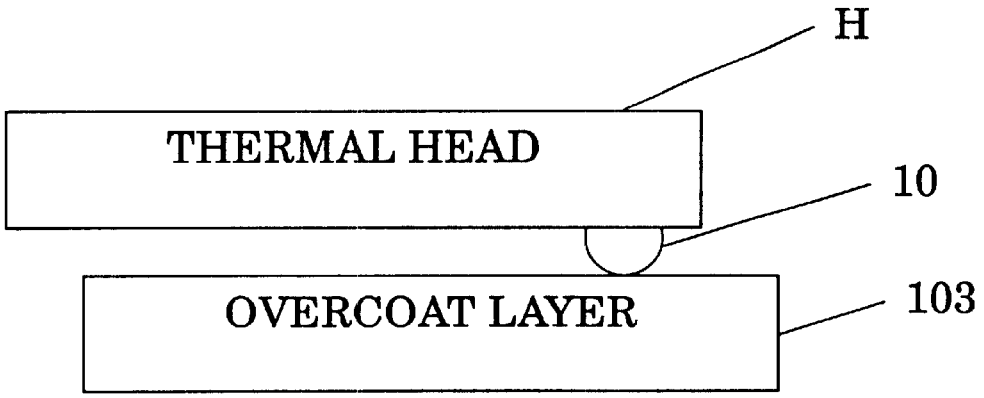
FIG. 9 is a schematic view illustrating a sticking phenomenon.
Figure 10:
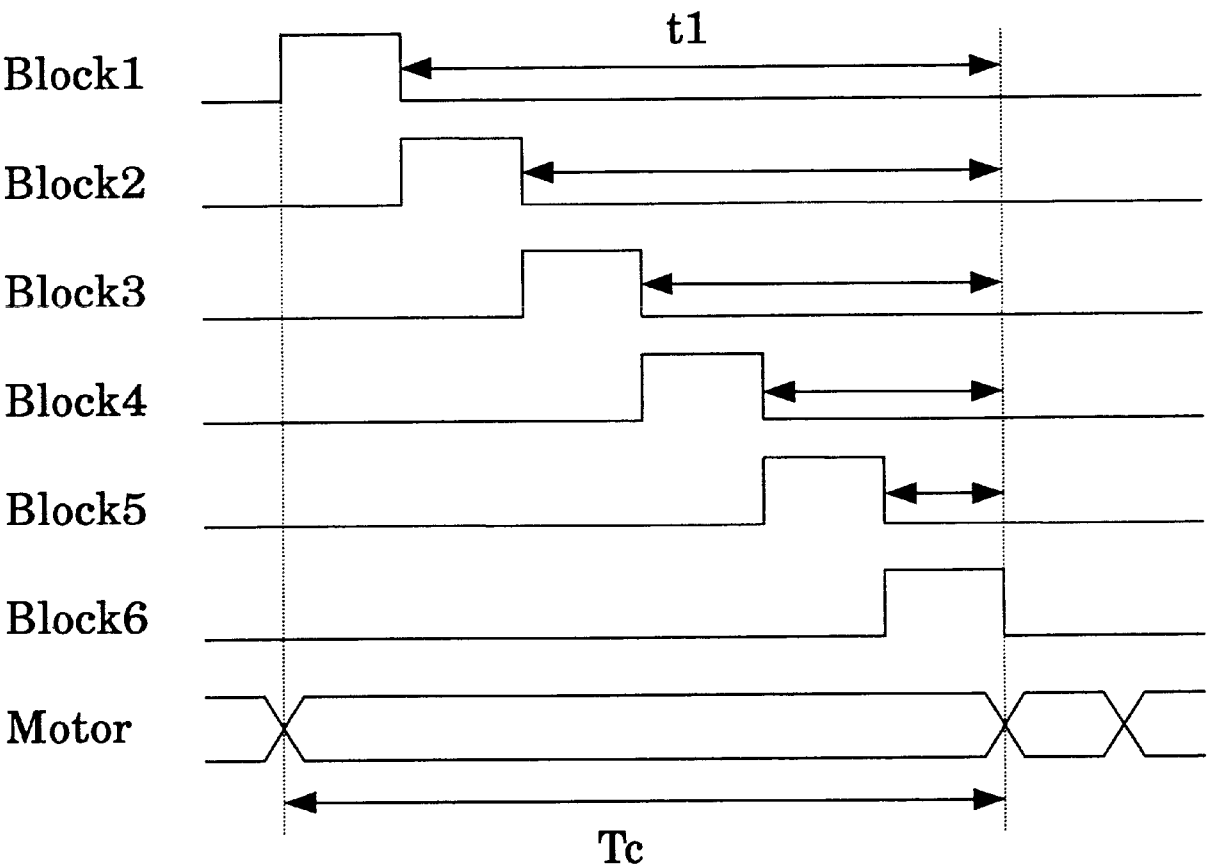
FIG. 10 PRIOR ART
FIG. 10 is a time chart illustrating a conventional method of driving a thermal line printer.
Figure 11:
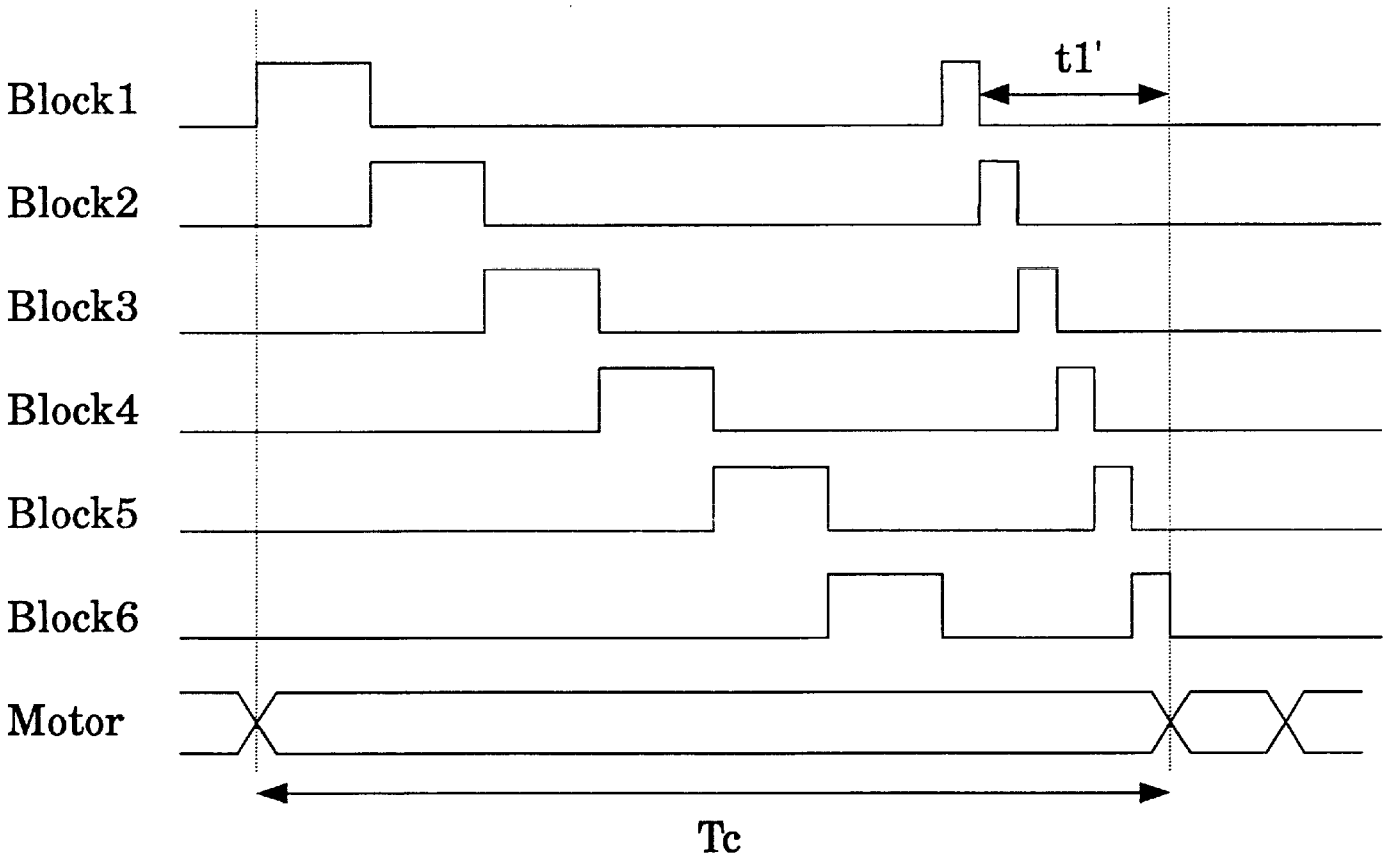
FIG. 11 PRIOR ART
FIG. 11 is a time chart illustrating a conventional method of driving a thermal line printer which is contrived to avoid the sticking phenomenon.

FIGS. 6 and 7 are the flowcharts showing the procedure of the printing process to be performed by the CPU 21 shown in FIG. 1.

This printing process is started in the case where the power is turned on or in the case where the printing mode is selected by the operation of a mode switch or the like. When this process is started, first of all, in step S1, judgement is made whether or not the printing data sent from, for example, an external host computer is received. If the printing data is not received, the process of step S1 is repeated until the printing data is received. If the printing data is received, the program goes to the process of step S2.

In step S2, data format or the like of the received data is analyzed, and the received data is stored in the signal receiving buffer 22. Then, the program goes to step S3.

In step S3, judgement is made whether or not the data stored in the signal receiving buffer 22 reaches the data corresponding to one line. If not, the process of steps S1 to S3 is repeated until the reception of the data for one line. If so, the program goes to the next step S4.

In step S4, the received data for one line is converted into the printing data representative of the dot pattern corresponding to one line, which is temporarily stored in the one line printing data buffer. The program goes to the next step S5.

In step S5, in order to judge whether or not the printing for one line is completed, judgment is made whether or not the shift register 31 of the thermal line head 3 is vacant. If not, this step S5 is repeated while being on standby until the shift register 31 becomes vacant. if so, the program goes to the next step S6.

In step S6, the printing data for one line is transferred to the shift register 31 of the thermal line head 3 in a serial manner. The program goes to step S7. In step S7, the printing dot number (electrified dot number) of each printing block is counted and stored in the dot number buffer 24. The program goes to the next step S8.

In step S8, judgement is made whether or not the printing data for one line has been transferred. If not, the process of step S8 14 is repeated until the data is transferred. If so, the program goes to the next step S9.

In step S9, on the basis of the printing dot number of each printing block counted in step S7, judgment data is prepared for judging whether or not the sum of the printing dots in each set of printing blocks exceeds the maximum electrified dot number. Then, the program goes to step S10.

In step S10, in the case where the judgment data prepared in step S9 exceeds the maximum electrified dot number, the mode for dividing the printing blocks in one set and for driving the blocks alternately is adopted. The program goes to step S11. Also, in the case where the data prepared in step S9 does not exceed the maximum electrified dot number, the simultaneous drive mode is adopted. The program goes to step S13.

As a result, in the case where the program goes to step S11, the drive time period of the heating resistors is calculated on the basis of the detection temperature by the thermistor of the thermal line head 3 or the like, and divided by the pulse width to determine the number of application of pulse, i.e., the division drive times (for example, two times to four times). For instance, it is determined that if the temperature of the thermal line head 3 is high, the number of the division drive times is small, whereas if the temperature of the thermal line head 3 is low, the number of the division drive times is large. Incidentally, regardless of the division drive times, the time period for one drive (pulse width) is fixed to a predetermined short period (0.5 milliseconds). After the number of the drive times has been determined, the process goes to step S12.

In step S12, the signals corresponding to the blocks to be driven out of the strobe signals STB1 to STB6 are outputted alternately for the drive of the division drive times determined in step S11. The program goes to step S14.

On the other hand, in the case where it is judged in the judgment process of step S10 that the simultaneous drive should be adopted and the program goes to step S13, two signals corresponding to the blocks to be driven out of the strobe signals STB1 to STB6 are outputted for driving one set of printing blocks. The program goes to step S14.

In step 514, one pulse is sent to the stepping motor 4 to perform one step drive of the motor (drive for one fourth dot). Then, the program goes to step S15.

In step S15, judgement is made whether or not all the strobe signals STB1 to STB6 are sent to complete the printing for one line. If the result is "NO", the program returns back to step S10 to execute the printing process for the next set of printing blocks. On the other hand, if "YES", the printing process for one line is finished, and the program returns back to step S1 for repeating the above-described operation for starting the printing process for the next line.

As described above, according to the thermal line printer 1 and the drive method therefor according to this embodiment, the time frame from the electric supply completion of the heating resistors R, . . . of the thermal line heads 3 until the paper feed by the stepping motor is shortened, whereby the heating resistors R, . . . and the thermal paper may be separated to avoid the occurrence of the sticking phenomenon.

Also, in accordance with the method of simultaneously driving two printing blocks in the case where the printing dot number is counted to be small, it is possible to increase the printing process speed and to avoid the sticking phenomenon while keeping the consumption power from exceeding a fixed level.

The present invention made by the present inventors has been specifically described with reference to its embodiment, but it is understood that the present invention is not limited to the embodiment above and various modifications or changes are possible within the scope of the appended claims.

For example, the number of the divisions of the blocks of the heating resistors of the thermal line head or the number of the sets may be changed as desired. Also, the amount of feed of thermal paper is not limited to one fourth dot but may be changed as desired. Moreover, the thermal paper is subjected to aging change, it tends to stick to the head. Therefore it is possible to change the drive time period or the division number in correspondence with the time elapsed from the date of manufacture. Also, since the likelihood of the occurrence of the sticking phenomenon is different according to the type of thermal paper, it is possible to change the drive time period or the division number in correspondence with the type of thermal paper.

According to the present invention, it is possible to suppress the degradation in printing quality such as non-uniformity in density caused by the sticking phenomenon in the thermal line printer while suppressing the consumption power, and at the same time, to use a variety of thermal paper while obviating the adverse affect caused by the aging change of the thermal paper.

What is claimed is:

1. A method of driving a thermal line printer for performing thermal printing onto thermal paper that is fed by a stepping motor with a thermal line head having a plurality of thermal resistors each for printing a dot onto the thermal paper, the thermal resistors being arranged in a linear manner on a line perpendicular to a paper feeding direction, the method comprising the steps of:

dividing the thermal resistors of the thermal line head into n blocks (where n is an integer not smaller than one), and selecting m groups (where m is an integer not smaller than zero) from the n blocks, each group comprising at least one of the blocks; and driving the groups in sequential order to print sequentially, and driving the stepping motor after driving each of the respective groups to feed the thermal paper in the paper feeding direction by a distance less than the size of one dot;

wherein the blocks in each of the groups are driven alternately in a time division manner when the amount of data to be printed by each group of thermal resistors is larger than a predetermined value.

2. A method of driving a thermal line printer according to claim 1; wherein a number of divisions in the time division driving is determined in accordance with a temperature of the thermal line head.

3. A method of driving a thermal line printer according to any one of claims 1 or 2; wherein the thermal resistors to be driven in each block of the groups are simultaneously driven continuously for a predetermined period of time when the amount of data to be printed by each group of the thermal resistors is equal to or less than the predetermined value.

4. A method of driving a thermal line printer according to claim 1; wherein m and n are greater than one, and the step of driving the stepping motor after driving each of the respective groups comprises the step of driving the stepping motor to feed the thermal paper by a distance equal to a fractional size of a dot equal to the inverse of m.

5. A method of driving a thermal line printer according to claim 4; wherein n is four, m is two, and the fractional size of the dot is ¼ of the dot size.

6. A thermal line printer according to claim 5; wherein n is four, m is two, and the fractional size of the dot is ¼ of the dot size.

7. A thermal line printer comprising: paper feed means for transferring thermal paper by driving a stepping motor; a thermal line head having a plurality of thermal resistors arranged in a linear manner on a line perpendicular to a paper feed direction; thermal line head dividing means for dividing the thermal resistors of the thermal line head into n blocks (where n is an integer not smaller than one), and selecting m groups (where m is an integer not smaller than zero) from the n blocks, each group comprising at least one of the blocks; control means for driving the groups in sequential order to print sequentially and driving the stepping motor after driving each of the respective groups to feed the thermal paper by a distance less than the size of one dot; judging means for judging whether the amount of data to be printed by each group of thermal resistors is larger than a predetermined level; and time division driving means for driving the thermal resistors in a time division manner in each block of the groups with a predetermined number of divisions when the judging means determines that the amount of data to be printed is at least the predetermined value.

8. The thermal line printer according to claim 7; wherein the control means comprises division number determining means for determining the number of divisions of the time division driving on the basis of a temperature of the thermal line head.

9. The thermal line printer according to any one of claims 7 or 8; further comprising simultaneous drive means for simultaneously driving the thermal resistors in each block of the groups continuously for a predetermined period of time when the judging means determines that the amount of data to be printed is equal to or less than the predetermined value.

10. A thermal line printer according to claim 7; wherein m and n are greater than one, and the control means drives the stepping motor after driving each of the respective groups to feed the thermal paper by a distance equal to a fractional size of a dot equal to the inverse of m.

11. A printer comprising: a feed mechanism for feeding a recording medium in a feeding direction; a print head having a plurality of printing elements each for printing a dot on the recording medium; and a processing unit for dividing the printing elements of the print head into a plurality of groups, driving each group to print sequentially, and driving the feed mechanism after the driving of each group to feed the recording medium in the feeding direction by a distance less than the size of one dot so that the print head does not stick to the recording medium, the distance being set such that no gap appears between successive lines of printing in the same groups.

12. A printer according to claim 11; wherein the print head comprises a thermal line head having a plurality of thermal resistors arranged in a linear manner perpendicular to the feeding direction.

13. A printer according to claim 11; wherein the processing unit determines whether an amount of data to be printed on one line on the recording medium by each group is larger than a predetermined value, drives each of the groups in a time division manner so that each individual group is alternately and intermittently driven when the amount of data to be printed on the line is at least the predetermined value, and drives each of the groups to print simultaneously when the amount of data to be printed on the line is less than the predetermined value.

14. A printer according to claim 13; wherein n is four, m is two, and the fractional size of the dot is ¼ of the dot size.

15. A printer according to claim 11; wherein the processing unit divides the printing element into n blocks, wherein n is an integer, and selects m groups (where m is an integer) from the n blocks, each group comprising at least one of the blocks, and drives each block of the groups in a time division manner so that each group is intermittently and alternately driven when the amount of data to be printed by each group is larger than a predetermined value.

16. A printer according to claim 15; wherein a number of divisions in the time division driving is determined in accordance with a temperature of the print head.

17. A printer according to claim 15; wherein the processing unit drives each block of the respective groups simultaneously when the amount of data to be printed by each group is equal to or less than the predetermined value.

18. A printer according to claim 15; wherein m and n each have a value of 2 or more, and the processing unit drives the stepping motor after driving each of the respective groups to feed the thermal paper by a distance equal to a fractional size of a dot equal to the inverse of m.

* * * * *